US005564500A

United States Patent [19]

Rogers et al.

[11] Patent Number: 5,564,500

[45] Date of Patent: Oct. 15, 1996

[54] APPARATUS AND METHOD FOR REMOVING GELLED DRILLING FLUID AND FILTER CAKE FROM THE SIDE OF A WELL BORE

[75] Inventors: Henry E. Rogers, Duncan; Dick A. Murray, Wilson; Earl D. Webb, Healdton, all of Okla.

[73] Assignee: Halliburton Company, Duncan, Okla.

[21] Appl. No.: 504,382

[22] Filed: Jul. 19, 1995

[51] Int. Cl.[6] ..... E21B 21/00; E21B 37/00

[52] U.S. Cl. ..... 166/312; 166/318; 166/319; 166/335; 166/222; 175/317

[58] Field of Search ..... 175/317, 320, 175/324, 237; 166/318, 332.4, 335, 312, 222

[56] References Cited

U.S. PATENT DOCUMENTS

| | | | |
|---|---|---|---|
| 1,279,333 | 9/1918 | Green | 166/222 |
| 2,212,491 | 8/1940 | Appleby | 166/312 X |
| 2,828,107 | 3/1958 | Bobo | 175/69 |
| 2,882,020 | 4/1959 | Carr et al. | 175/317 X |
| 3,066,735 | 12/1962 | Zingg | 166/55 |
| 3,116,800 | 1/1964 | Kammerer | 175/317 |
| 3,795,282 | 3/1974 | Oliver | 175/65 |
| 3,907,046 | 9/1975 | Gaylord | 175/317 X |
| 4,518,041 | 5/1985 | Zublin | 166/312 |
| 4,645,006 | 2/1987 | Tinsley | 166/318 X |
| 4,749,044 | 6/1988 | Skipper et al. | 166/312 X |
| 4,967,841 | 11/1990 | Murray | 166/312 |
| 5,368,103 | 11/1994 | Heathman et al. | 166/289 |

OTHER PUBLICATIONS

Drawing identified as Exhibit A showing prior art fluid diverter.

U.S. patent application Ser. No. 08/250,412.

Drawing identified as Exhibit B showing a jetting tool.

*Primary Examiner*—Stephen J. Novosad

*Attorney, Agent, or Firm*—Craig W. Roddy; Anthony L. Rahhal

[57] ABSTRACT

A drill stem diverter tool for removing gelled drilling fluid and filter cake from the side of a well bore. The apparatus comprises a housing adapted to be connected into a drill string. The housing includes a plurality of diverter ports which communicate a central opening of the housing with a well annulus. A valve means which can be moved from a first position which blocks the diverter ports to a second position which opens the diverter ports is disposed in the central opening. The diverter ports are angled and offset from the center line of the housing so that the fluid exiting the ports creates a turbulent circular motion. A stop is provided to limit the movement of the valve means. The valve means may also be moved from its second position back to its first position to block communication to the well annulus through the diverter ports.

50 Claims, 8 Drawing Sheets

APPARATUS AND METHOD FOR REMOVING GELLED DRILLING FLUID AND FILTER CAKE FROM THE SIDE OF A WELL BORE

BACKGROUND OF THE INVENTION

This invention is directed to methods and apparatus for removing gelled drilling fluid and filter cake from well bores, and more particularly to methods and apparatus for removing gelled drilling fluid and filter cake prior to and during the removal of the drill string after the drilling of the well bore has begun. The invention is further directed to removing gelled mud, filter cake and other debris from equipment used during the drilling of offshore wells such as, but not limited to, subsea assemblies and riser pipes.

In the construction of oil and gas wells, a well bore is drilled into one or more subterranean formations or zones containing oil and/or gas to be produced. The well bore is typically drilled utilizing a drilling rig which has a rotary table on its floor to rotate the drill string or other pipe during drilling and other operations. The drilling rig may also have a top drive mechanism for rotating the drill string which is integral with the traveling block of the rig in addition to or instead of a rotary table. In addition, the well bore can be drilled using a downhole drilling mechanism.

During the drilling of the well bore, drilling fluid, which is also referred to as drilling mud, is circulated through the well bore by pumping it down the drill string through the drill bit. When the fluid exits the drill bit, it flows upwardly back to the surface through the annulus between the walls, or sides of the well bore and the drill string. A variety of different types of drilling fluid exist, and the circulation of such fluid functions to, among other things, lubricate the drill bit, remove cuttings from the well bore as they are produced, exert hydrostatic pressure on pressurized fluid contained in formations and seal off the walls of the well bore so that the fluid is not lost into the permeable subterranean zones penetrated by the well bore.

As the drilling fluid circulates through the well bore, it deposits a filter cake of solids from the drilling fluid, along with gelled drilling fluid over the walls of the well bore. In most instances, after the well bore has been drilled to a desired depth, the drill string is removed and a string of casing is run into the well bore. After the casing string is run in the well bore, cementing operations are usually performed. That is, the pipe is cemented or bonded in the well bore by placing a cementitious slurry, or other settable fluid, in the annulus between the side of the well bore and the casing string.

The cementitious slurry sets into a hard impermeable mass and will bond the casing string to the well bore. Cementing seals the annulus and prevents fluid communication between subterranean zones or to the surface by way of the annulus. In order for the cementing to be successful, the gelled and dehydrated drilling fluid and filter cake deposited on the walls of the well bore must be removed. If an appreciable amount of drilling fluid and filter cake remain on the walls of the well bore, the cementitious fluid will not properly bond thereto and fluid leakage through the annulus and other major problems will result.

Various methods have been used to attempt to remove gelled drilling fluid and filter cake from the walls of a well bore. One method of removing such debris has been to simply increase the velocity of fluid circulated through the drill string and the drill bit after the well bore has been drilled to create a more turbulent flow up the annulus, thereby removing some gelled fluid and filter cake from the well bore walls. Fluids may also be pumped through the casing string at high flow rates as the casing string is lowered into the well to create turbulent flow in the well bore. The fluids used can be drilling fluid or any other fluid known and used in the art for removing gelled drilling fluid and filter cake from the walls of a well bore. In addition, the drill string can be removed from the well and the drill bit removed and replaced with a fluid diverter on the end of the drill string. The string can then be lowered back into the well and the fluid can be displaced through the drill string and the diverter which has holes defined therethrough. Finally, mechanical scrapers have been attached to the casing so that as the casing is run into the well bore it physically contacts and breaks up some of the drilling fluid and filter cake.

While the above described methods and other prior art techniques have achieved varying degrees of success, there is a need for improved methods and apparatus for removing filter cakes and gelled drilling fluids from the walls of a well bore prior to removing the drill string from the well bore and without the need for subsequent trips into the hole with the drill string.

There is also a need for methods and apparatus which can remove gelled fluid, filter cake and other debris from the riser pipe and subsea assemblies used in the drilling of offshore wells without the need for special trips in and out of the offshore well. The riser pipe, as is well known in art, is a flexible pipe which connects an offshore rig to the subsea assembly. The subsea assembly, which is located on the sea floor over the wellbore, typically includes equipment such as, but not limited to, the well head and blowout preventers. The drill string utilized to drill the well passes through the riser pipe and subsea assembly so that during drilling operations, drilling fluid will circulate through the riser pipe and subsea assembly, and gelled mud, filter cake and other debris will build up thereon. The gelled mud and filter cake must be removed periodically so that the equipment in the subsea assembly is not damaged and so that the operation of such equipment is not impaired. Likewise, gelled mud and filter cake must be removed from the internal diameter of the riser pipe so that drilling operations are not impaired. If the buildup is not removed periodically, it can become so great that chunks of filter cake and other debris will break free. Such chunks can damage the subsea assembly and impair drilling operations.

To date, the primary method employed to remove the build up of filter cake and gelled mud from the subsea assemblies and riser pipe is simply to remove the drill string from the well, remove the drill bit and attach a jetting tool on the end of the drill string as opposed to the drill bit. The jetting tool, as is well known in the art, has a plurality of ports defined therethrough, with the ports having nozzles received therein. Once the drill bit has been replaced with the jetting tool, the drill string is lowered through the riser pipe and subsea assembly and then removed therefrom as fluid is circulated through the drill string. The fluid circulated through the strings will exit the tool at a high velocity through nozzles thereby cleaning the subsea assembly and removing gelled mud, filter cake and any other debris from the inside of the subsea assembly and riser pipe. Although the above described method will adequately clean the subsea assembly and remove the gelled mud and filter cake, there is a need for method and apparatus which will clean the subsea assembly and remove debris from the inside of the riser pipe without the need for special trips in and out of the well for the sole purpose of cleaning the subsea assembly and riser pipe.

SUMMARY OF THE INVENTION

The present invention provides an improved method and apparatus for removing gelled drilling fluid and filter cake from the walls of a well bore which meet the above described needs and which overcome the shortcomings of the prior art. The present invention also provides an improved method and apparatus for removing gelled mud, filter cake and other debris from subsea assemblies and riser pipe used in the drilling of offshore wells.

The apparatus of the present invention, which may be referred to as a drill string diverter sub, generally comprises a housing having an outer surface and an inner surface. The inner surface defines a longitudinal central opening through the housing. The housing has an upper end and a lower end and is adapted to be connected to and disposed in a drill string having a drill bit attached to a lower end thereof. The central opening of the housing is communicated with a central bore of the drill string thereby defining a central flow passage wherein fluid can be pumped or otherwise displaced through the drill string and drill bit into an annulus defined between the drill string and the well bore and upward to the surface.

The diverter sub also has a plurality of diverter ports defined through the housing for communicating the central opening with the well annulus. The diverter ports have an exit opening defined on the outer surface of the housing and an entrance opening defined on the inner surface.

A valve means is slidably disposed in the central opening and is movable from a first, or closed position wherein the entrance opening of the diverter ports is blocked by the valve means thereby preventing communication through the diverter ports between the well annulus and said central opening, and a second, or open position wherein the entrance openings, and thus the diverter ports are opened, thereby establishing communication between the central opening and the well annulus.

The valve means may also be movable from its second position back to its first position, so that communication between the central opening of the housing and the well annulus through the diverter ports can be closed. Thus, the valve means is capable of being alternated between its first, or closed, and second, or open position, so that fluid can be communicated into the annulus to clean the filter cake and gelled drilling fluid from the well bore at selected locations, and then closed so that the drill string, and thus the diverter sub may move to a separate location, where the valve means can be moved again to its second position and the diverter ports reopened.

The plurality of diverter ports may include a set of diverter ports, the set being defined by at least two (2) diverter ports having exit openings located at the same vertical distance from the upper end of the housing. The diverter ports in a set may be equally spaced radially around the housing. In other words, the exit openings of the diverter ports in a set may be equally spaced radially on the outer surface of the housing, and the entrance openings may be equally spaced on the inner surface of the housing. The plurality of diverter ports may include more than one set of diverter ports, with the sets being vertically spaced from each other.

The exit opening of each diverter port may also be spaced vertically from the entrance opening, so that a longitudinal central axis of the diverter port is at an angle from a line perpendicular to a longitudinal central axis of the central opening of the housing. Thus, the exit opening may be spaced vertically upward from the entrance opening of the diverter ports so that fluid communicated down the drill string enters the diverter ports and is redirected in an upward direction in the well annulus.

Each diverter port may also be offset from the center of the central opening, so that the longitudinal central axis of the diverter port does not intersect the longitudinal central axis of the central opening of the housing. The ports may be located such that when viewed looking down from the upper end of the housing, the longitudinal central axis of each diverter port appears to be offset from and parallel to a radial axis of the central bore of the housing. The longitudinal central axis of each diverter port may therefore lie in a vertical plane parallel to a plane defined by the longitudinal central axis of the central opening bore and a radial axis of the central opening. The diverter ports may also be described as having a long side and a short side, wherein the long side rests in a line that is tangent to the inner surface of the housing.

The method of operating the apparatus comprises displacing fluid down the drill string and obstructing the flow at a point above the drill bit. Flow may be obstructed by dropping an actuating bomb or plug into the drill string after the well bore has been drilled. The actuating plug, which may be referred to as an actuating means, will engage the valve means which is in the first position as the well bore is being drilled. The valve means is releasably attached in the first position, so that when pressure in the drill string is increased after the actuating plug is dropped, the valve means will release and move to the second position. The valve means is held in the second position by a limiting means disposed in the housing.

The actuating plug will block flow through the central opening so that fluid pumped or otherwise displaced down the drill string into the central opening is communicated, or injected through the diverter ports into the well annulus. The diverter ports direct the fluid into the annulus and into the wall of the well bore so as to remove gelled fluid and filter cake from the well bore walls.

The velocity of the fluid exiting the ports will be greater than the velocity of the fluid passing through the drill string, because the cross-sectional area of the central opening is greater than the total cross-sectional area of the diverter ports. Additionally, because the diverter ports are offset, the fluid exiting the tool causes a turbulent circular flow around the diverter sub. The increased velocity and the circular flow near the tool enhances the cleaning of the well bore.

Fluid can be continually circulated through the diverter ports as the drill string is raised and removed from the well bore. The side of the well bore can thus be washed at various selected locations as the drill string is retrieved. Additionally, the actuation plug can be removed and the valve means can be moved back and releasably attached to its first position to block flow through the diverter ports while the drill string is in the well bore.

Drilling can then continue, or the drill string can otherwise move to a different location in the well. The valve means can again be moved to its second position and the walls at the new location can be washed. The sleeve can thus be alternated between its open and closed positions, so that the well can be washed at numerous selected locations.

A jetting nozzle may also be received in each of the diverter ports so that the diverter ports comprise jetting ports, and the diverter sub of the present invention comprises a jetting sub. The jetting nozzle has a nozzle exit with a diameter smaller than the diameter of the diverter port so that fluid exiting the jetting sub will exit at a much higher velocity than fluid exiting the diverter sub when the linear velocity through the drill string is the same. The jetting sub may be used on offshore drilling rigs to clean gelled mud, filter cake and other debris from subsea assemblies and riser pipes without the need for special trips in and out of the well.

Because the jetting sub is a integral part of the drill or work string, the sleeve therein can be moved from its first to its second position while the drill string is in the well and prior to its removal for drill bit changes or any other purpose. Thus, each time the drill string is removed, the jetting ports can be opened as described above by dropping an actuating plug into the drill string so that it engages the valve means and increasing pressure so that the valve means moves from its first to second positions thereby opening the jetting ports. Fluid is displaced down the string and out the jetting port, so that the fluid is injected at a sufficient velocity to clean the subsea assembly and to remove gelled mud and filter cake from the riser pipe as the drill string is withdrawn through the subsea assembly and the riser pipe to the platform of the offshore drilling rig. Such washing can occur each time the drill string is removed for any purpose such as but not limited to replacing the drill bit. The sleeve can be moved back from its second to its first position prior to the lowering the drilling string through the riser pipe and subsea assembly into the well for the continuation of drilling operations, so that when the string must once again be removed for any purpose, the jetting ports can be reopened and washing can occur as the drill string is removed. Thus, the invention provides a method and apparatus whereby the subsea assembly and riser pipe can be cleaned each time the drill string is withdrawn therethrough, and the need for special trips to perform such cleaning is eliminated.

BRIEF DESCRIPTION OF THE DRAWINGS

FIG. 6 shows a cross section of the embodiment of FIG. 5 with the diverter ports open.

FIG. 9 is a schematic showing the drill stem diverter apparatus attached to a drill string in a well bore. FIG. 9 does not show the valve means.

FIG. 16 shows a view from line 16—16 of FIG. 12.

DETAILED DESCRIPTION OF A PREFERRED EMBODIMENT

Figure 14:
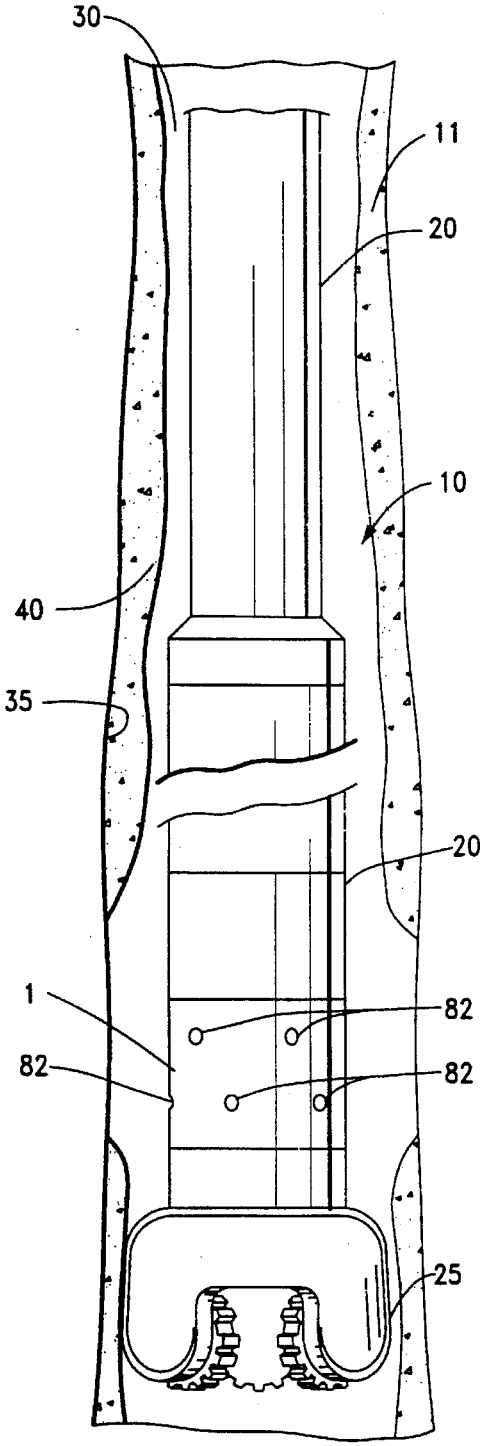
FIG. 14 schematically shows a diverter tool in a well bore.
Figure 15:
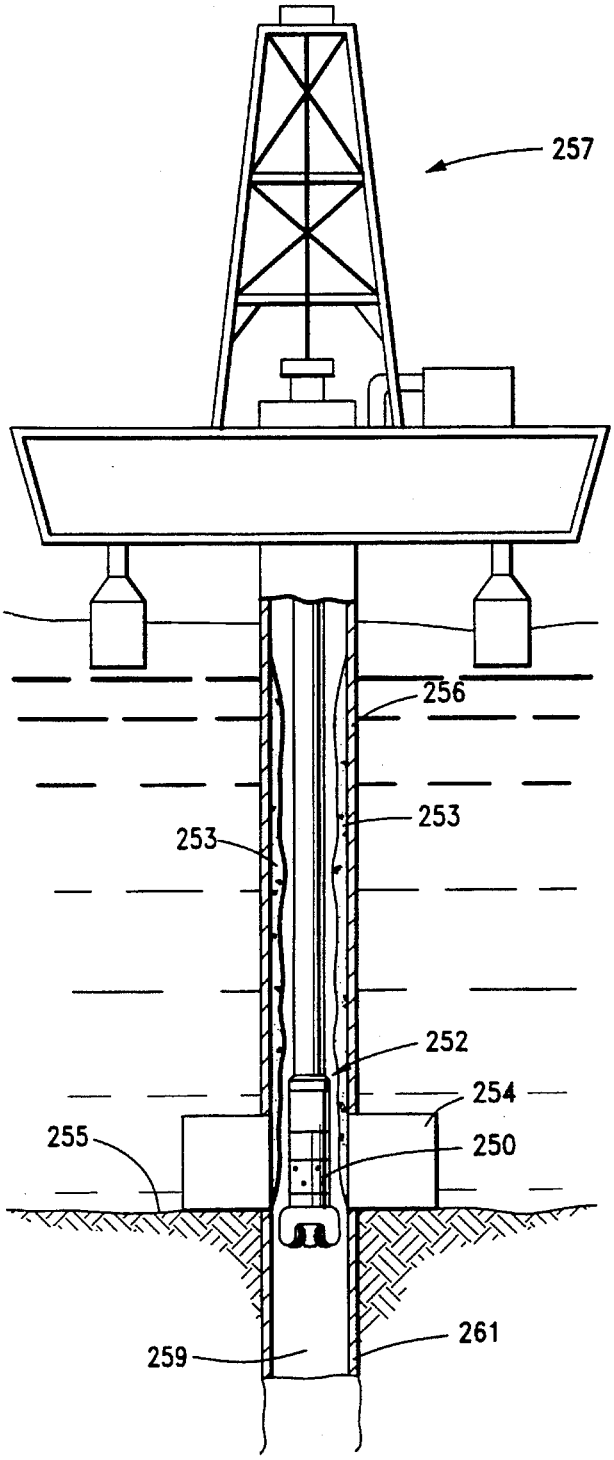

Referring now to the drawings and more particularly to FIGS. 1–4, an embodiment of the apparatus of the present invention, which may be generally referred to as a drill string diverter sub, is shown and generally designated by the numeral 1. Referring to FIGS. 9 & 14, the diverter sub is schematically shown as part of a tool 10 for removing gelled drilling fluid and filter cake 11 from the side of a well bore. FIG. 14 shows the tool in a well wherein the debris and filter cake 11 has been removed from a portion of the wellbore with the tool of the present invention. The tool 10 includes the diverter sub 1 disposed in a drill string 20 having a drill bit 25 attached to the lower end thereof. The tool is shown in a well bore 30 having walls or sides 35. A well bore annulus 40 is defined between the drill string and the well bore walls 35. In the embodiment shown, the diverter sub has a drill collar 60 attached thereabove and is connected to a bit sub 62 therebelow which is attached to the drill bit. However, one or more drill collars 60 can be attached to the lower end of the diverter sub so that the drill bit is a greater distance from the diverter sub 1. As schematically shown in FIG. 9, the drill string is comprised of a plurality of drill collars with a smaller diameter drill pipe attached thereabove, as is generally the case.

Referring now back to FIGS. 1–4, the diverter sub 1 includes a housing 45 having a valve means 50 disposed therein. The housing has an upper end 52 and a lower end 54 adapted to be connected to a drill string. In the embodiment shown, the housing has a female thread 56 defined at its upper end and a male thread 58 at its lower end 54. The upper end may be connected to a drill collar 60 which forms a portion of the drill string. As shown schematically in FIG. 9, the lower end may be attached to a drill collar or a drill bit sub which likewise forms a portion of the drill string 20 which has a drill bit attached to a lower end thereof.

Housing 45 further includes an outer surface 64, an inner surface 66 and a central opening 68. The central opening 68 is defined by inner surface 66, and has a longitudinal central axis 69. A valve retaining means 70, which may comprise a retaining groove 72 is defined on the inner surface of the housing. Retaining groove 72 has a groove diameter 73 and an upward facing shoulder 74. Central opening 68 is communicated with a central bore 76 of the drill string thereabove and therebelow. Central opening 68 and central bore 76 comprise a central flow passage 78 through which fluid can be pumped or otherwise displaced from the surface until it passes through the drill bit at the end of the drill string. Housing 45 further includes a communication means 80 for communicating central opening 68 with the well annulus 40.

Communication means 80 comprises a plurality of diverter ports 82 defined through the housing. The diverter ports may also be referred to as directing means for directing fluid displaced down the drill string into the side of the well bore. Each diverter port has an entrance opening 84 defined on inner surface 66, an exit opening 86 defined on outer surface 64 and a longitudinal central axis 88.

The plurality of diverter ports may be comprised of one or more sets of diverter ports. A set of diverter ports comprises at least two diverter ports having exit openings spaced downward the same distance from upper end 52 of housing 45. The embodiment shown in FIGS. 1–4 includes a first or upper set 90 of diverter ports and a second, or lower set 92. The exit openings of each diverter port in a set may also be equally spaced radially around the outer surface of the housing, and the entrance openings may be radially spaced equally around the inner surface of the housing. In the embodiment shown, sets 90 and 92 each include four diverter ports equally spaced radially around the housing.

The diverter ports in first set 90 may be referred to as ports 90A, 90B, 90C and 90D. As stated above, the exit opening of each diverter port in a set is spaced downward the same distance from upper end 52. Thus, the exit openings of each of diverter ports 90A–90D is spaced downward a distance 95 from upper end 52. The diverter ports in set 92 may be referred to as 92A, 92B, 92C and 92D. The exit opening of each of diverter ports 92A–92C second set 92 is spaced downward a distance 97 from upper end 52 and is spaced downward from the exit openings of diverter ports 90A–90D. Second set 92 is also rotated radially from first set 90 so that the exit openings of the diverter ports in set 92 are radially offset from the exit openings of the diverter ports in set 90. The radial offset between the sets can vary from 0° to 90°. In the embodiment shown, second set 92 is radially offset from set 90 approximately 45°.

The exit opening 86 of each diverter port may be spaced vertically from the entrance opening 84 so that fluid passing through the diverter ports is directed partially downward or upward and does not directly impinge on the walls of the well bore. In the embodiment shown, the exit openings 86 are spaced vertically upward from entrance openings 84 so that fluid is directed outwardly and upwardly as it leaves the exit openings. Thus, an angle 89 may be defined between the longitudinal central axis 88 of the diverter ports and a line parallel to a line 91 perpendicular to the longitudinal central axis 69 of central opening 68. In the embodiment shown, the diverter ports are shown at an angle of approximately thirty (30) degrees. However, the angle may vary between 0° and 60°.

Figure 7:
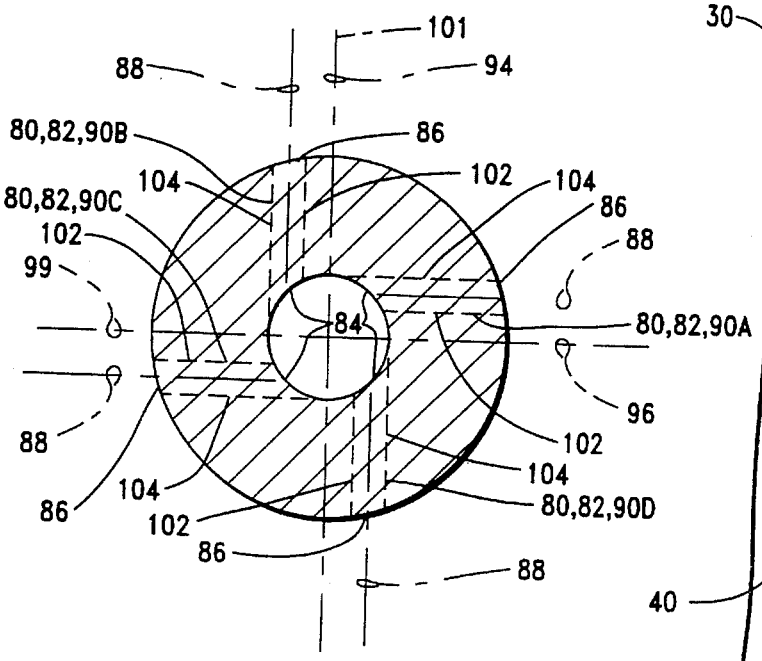
FIG. 7 shows a view from line 7—7 of FIGS. 3 and 5 without the valve or actuation means.
Figure 8:
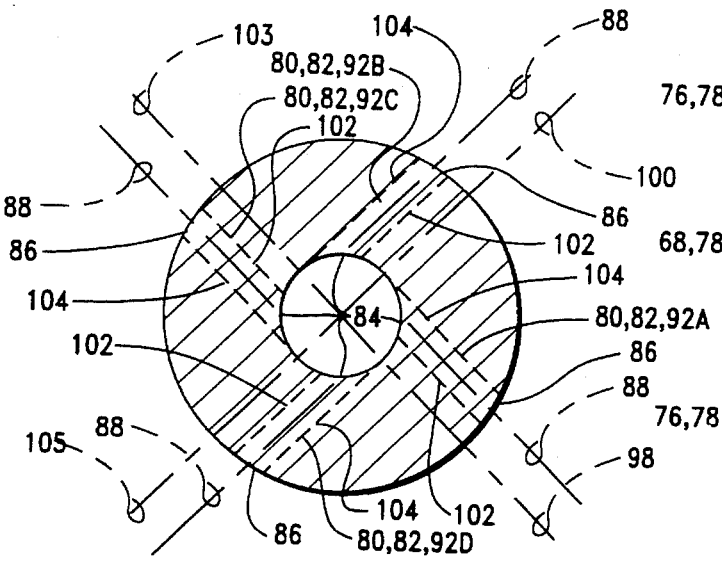
FIG. 8 shows a view from line 8—8 of FIGS. 3 and 5 without the valve or actuation means.
Figure 3:
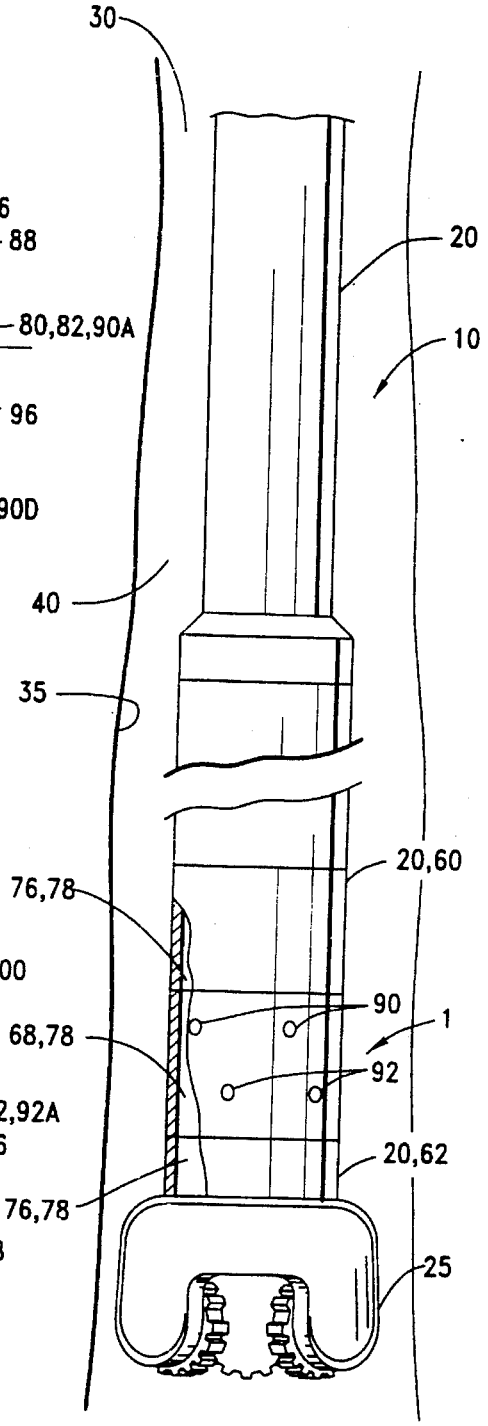

As better shown in FIGS. 7 and 8, the longitudinal central axis 88 of each diverter port may be offset from the center line of the central opening so that the longitudinal central axes 88 of the diverter ports do not intersect longitudinal central axis 69. The longitudinal central axis 88 of each diverter port may thus lie in a vertical plane parallel to and offset from a vertical plane defined by a radial axis of central opening 68 and longitudinal central axis 69.In a view looking downward from upper end 52 of the diverter sub, the diverter ports have a short side 102 and a long side 104, wherein long side 104 is tangent to inner surface 66 of housing 45.

In the embodiment shown, the longitudinal central axis of diverter port 90A lies in a plane that is parallel to and offset from a plane 99 defined by longitudinal central axis 69 and a radial axis 96 of central opening 69. Diverter port 90C has an exit opening rotated radially 180° from the exit opening of diverter port 90A, and the longitudinal central axis of diverter port 90C likewise lies in a plane parallel to and offset from plane 99. The planes described herein run in and out of the paper as shown in FIGS. 7 and 8, and thus appear as lines. In similar fashion, the longitudinal axis of diverter port 90B lies in a plane that is parallel to and offset from a plane 101 defined by longitudinal axis 69 of the central opening and a radial axis 94. Radial axis 94 is perpendicular to radial 96. The exit opening of port 90D is spaced radially 180° from the exit opening of diverter port 90B. The longitudinal central axis of diverter port 90D also lies in a plane parallel to and offset from plane 101.

The second set of diverter ports 92 is arranged in similar fashion and as described above is rotated radially from the first set. Thus, the longitudinal axis of diverter port 92A lies in a plane that is parallel to and offset from a plane 103 defined by a radial axis 98 and longitudinal axis 69. Likewise, longitudinal axis of port 92C lies in a plane that is parallel to and offset from plane 103. The exit openings of diverter ports 92A and 92C are radially spaced from one another 180°. Diverter port 92B lies in a plane that is parallel to and offset from a plane 105 defined by a radial axis 100 and longitudinal axis 69 of central opening 68. The longitudinal axis of diverter port 92D likewise rests in a plane that is parallel to and offset from plane 105. The exit openings of diverter ports 92B and 92D are radially spaced from one another 180° in the embodiment shown. Radial axis 98 is rotated 45° from radial axis 96 so that the exit openings of the diverter ports in set 92 are, as hereinbefore described, rotated radially 45° from the exit openings of the diverter ports in set 90.

Figure 1:
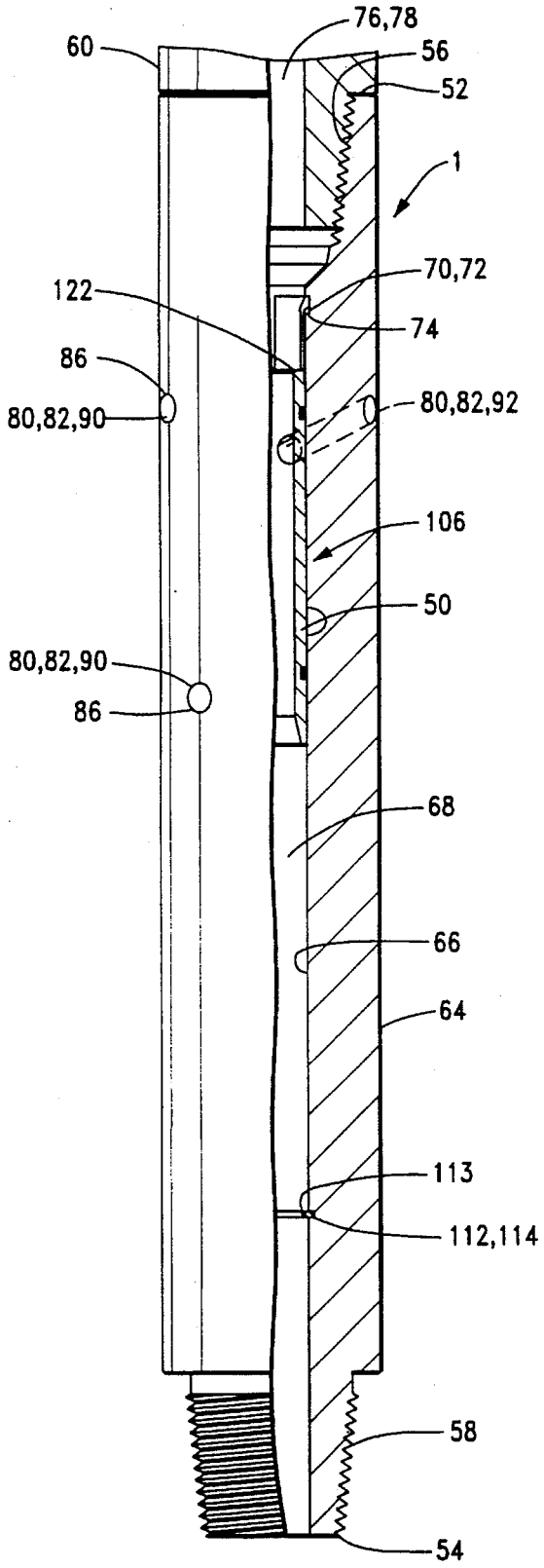
FIG. 1 shows a partial cross section view of a preferred embodiment of the drill stem diverter sub of the present invention.
Figure 2:
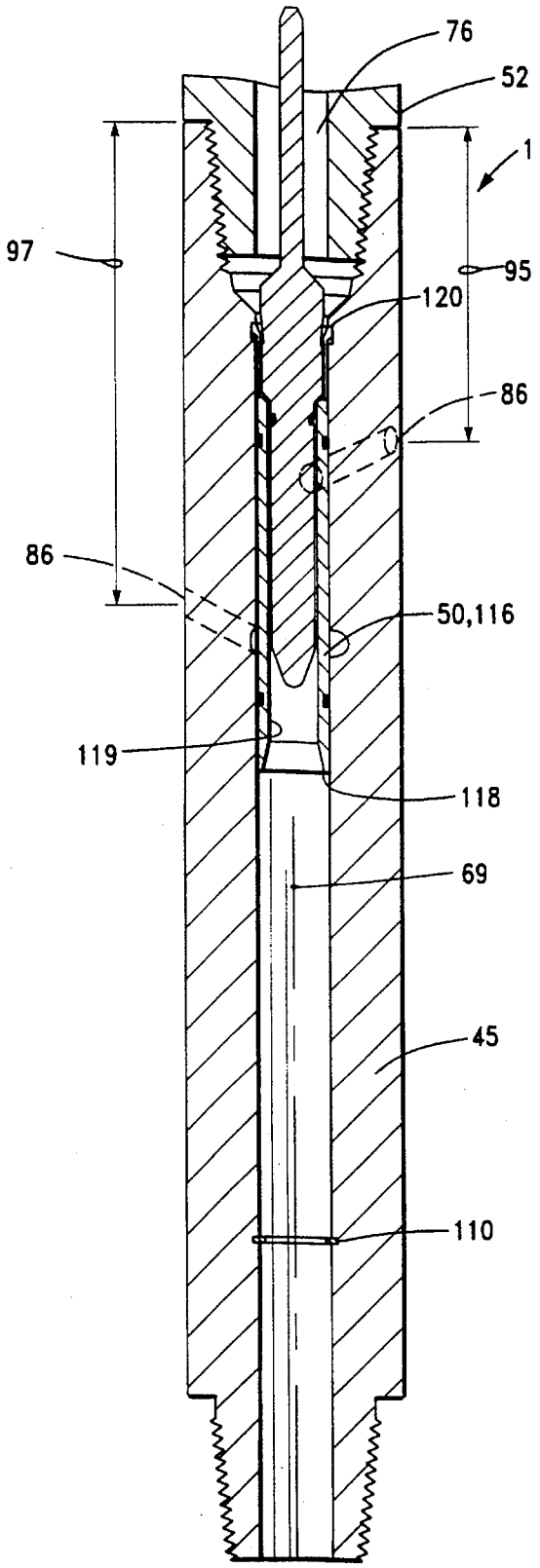
FIG. 2 shows a cross section of the apparatus with an actuation means.
Figure 3:
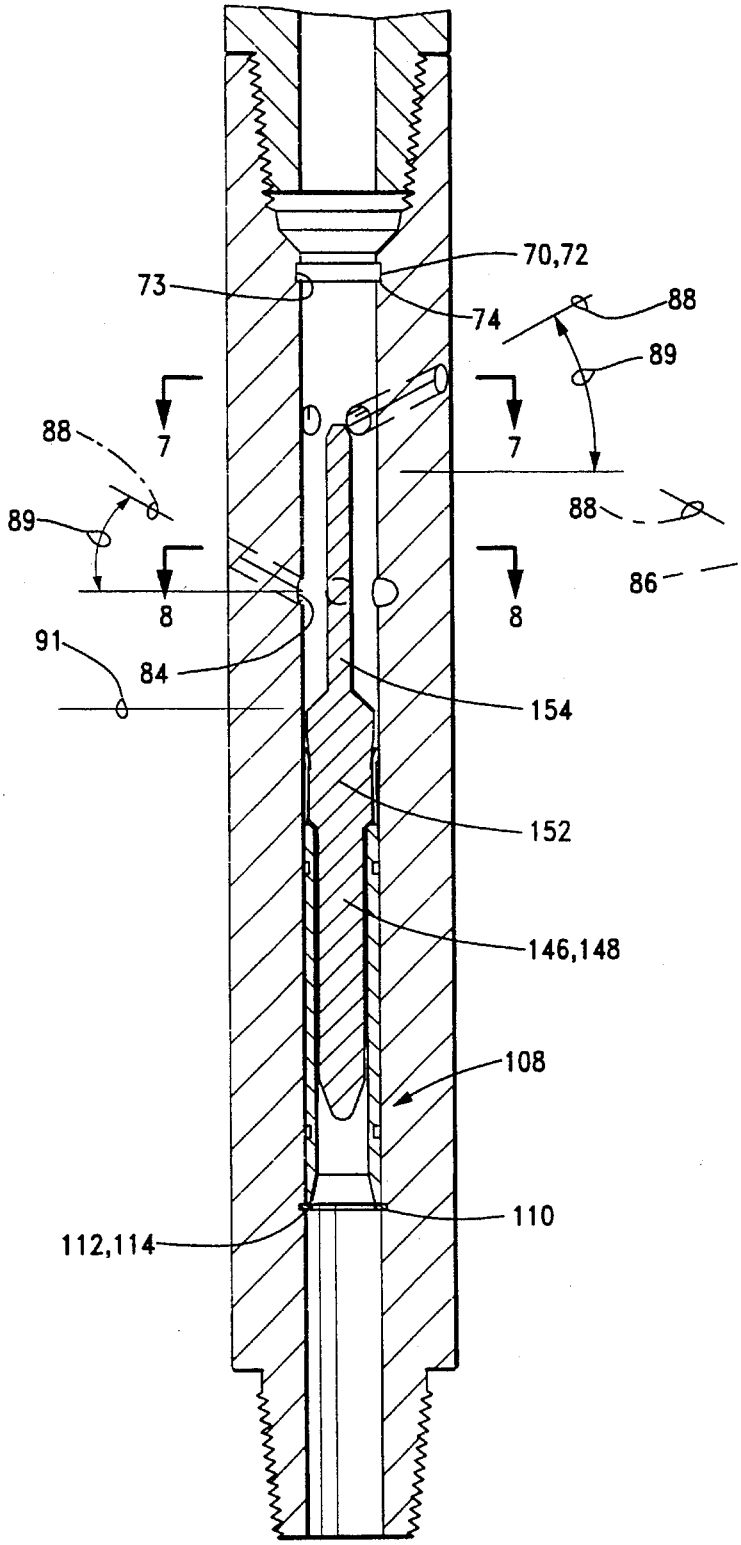
FIG. 3 shows a cross section of the apparatus with the diverter ports open.
Figure 4:
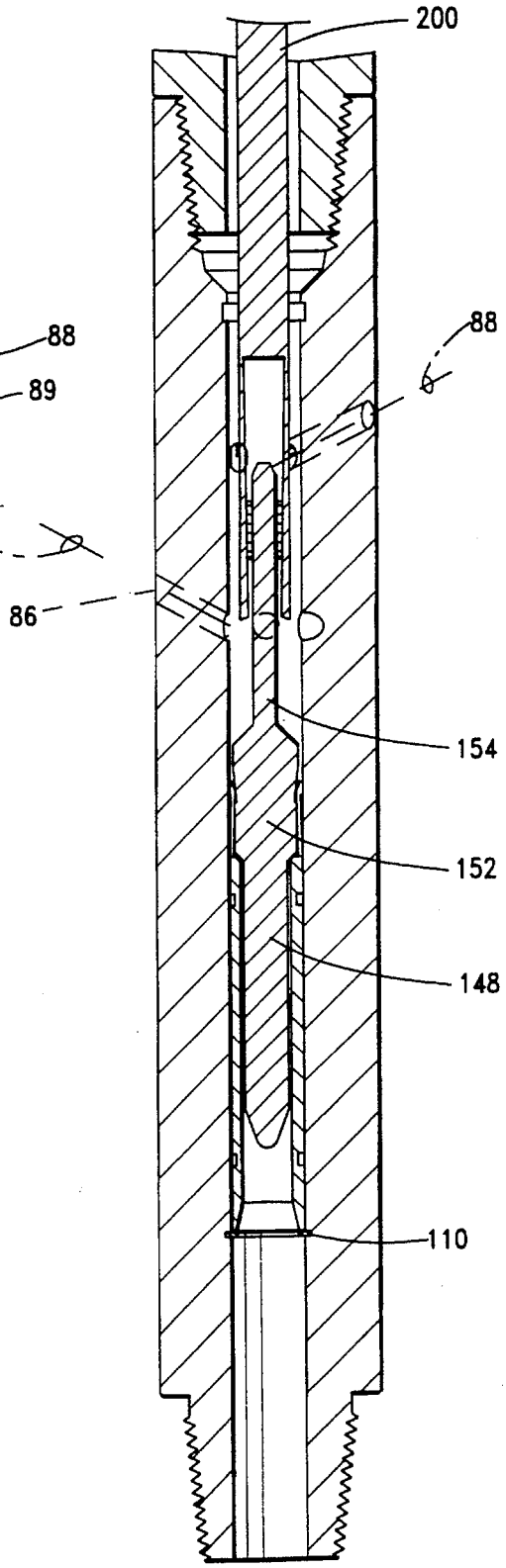
FIG. 4 shows a cross section of the apparatus along with the cross section of a fishing tool which can be utilized to withdraw the actuating plug and to return the valve means to its first position.

Referring now back to FIGS. 1 and 2, valve means 50 is shown in a first position 106, and is shown in a second position 108 in FIGS. 3 and 4. Housing 45 includes a limiting means 110 which is characterized by a shoulder defined in the housing. In the embodiment shown in FIGS. 1–4, the limiting means comprises a snap ring 112 which extends radially inwardly into central opening 68 is located in a groove 114 defined on inner surface 66. The portion of the snap ring extending inwardly may be referred to as a shoulder 113.

Figure 10:
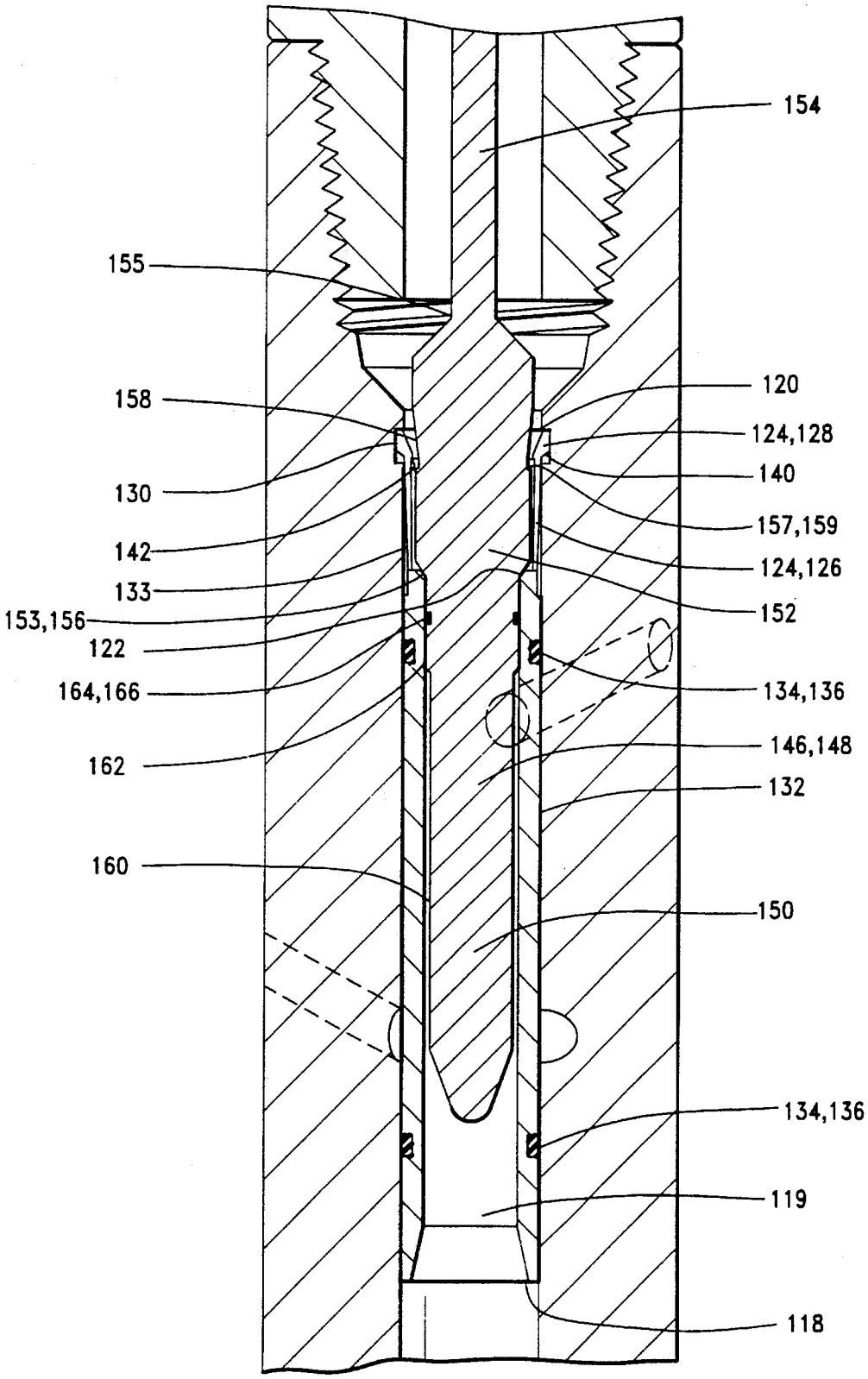
FIG. 10 shows an enlarged view of the actuation means and valve means engaged.
Figure 11A:
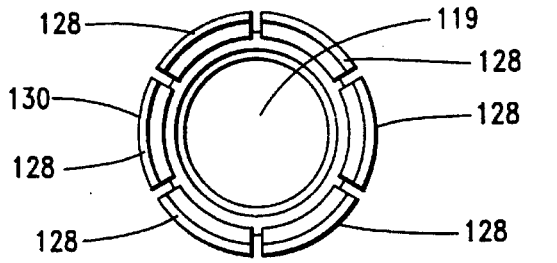
FIG. 11A shows an end view of the valve means of the present invention.
Figure 11B:
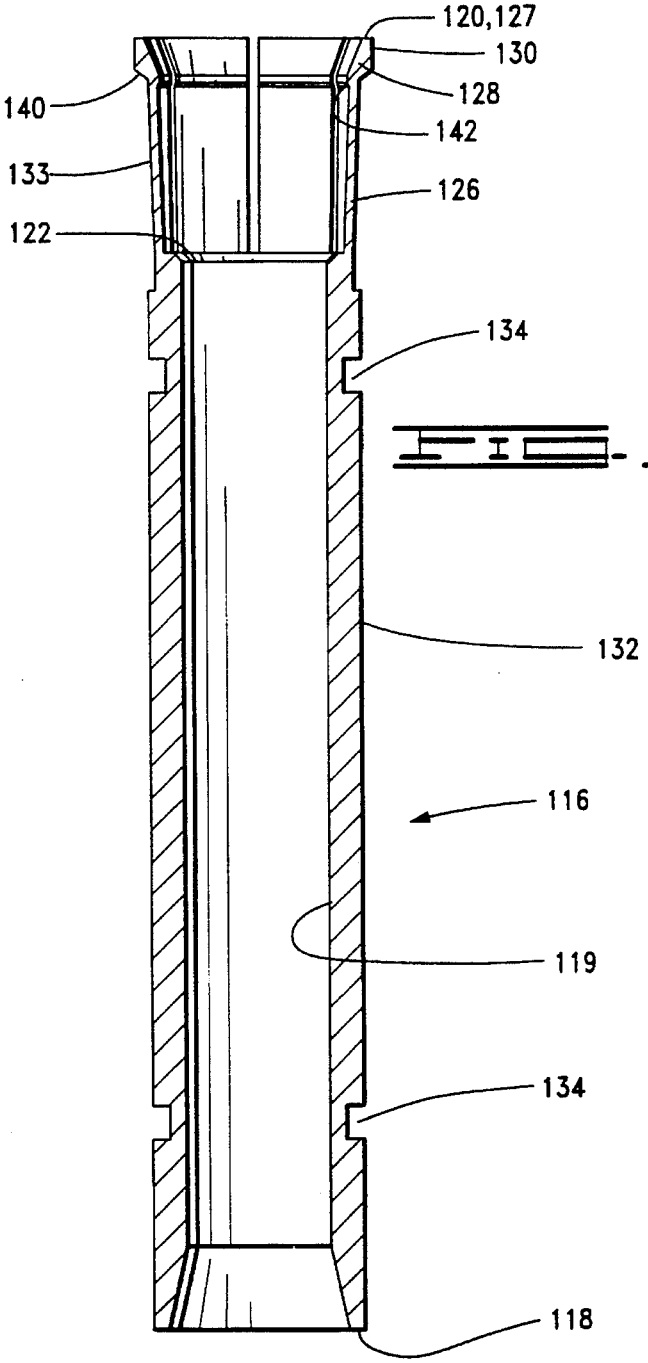
FIG. 11B shows a cross sectional view of the valve means of the present invention.

Valve means 50 may be comprised of an opening sleeve 116 having a lower end 118, an upper end 120 and a sleeve bore 119. The features of the opening sleeve are better seen in FIG. 10. Opening sleeve 116 includes a receiving seat 122 and a collet portion 124. Collet portion 124 is characterized by a plurality of collet fingers 126 extending upward from receiving seat 122 and a plurality of collet heads 128 at the upper end 127 of the collet fingers. Opening sleeve 116 further includes a first outer diameter 130 and a second outer diameter 132. The collet fingers define a third, or recessed outer diameter 133. First outer diameter 130 is defined on collet heads 128. Second outer diameter includes grooves 134 with o-ring seals 136 received therein for sealingly engaging inner surface 66. When sleeve 116 is in its first position as depicted in FIGS. 1 and 2, collet heads 128 are received in retaining groove 72. First outer diameter 130 may be slightly larger than groove diameter 73 of the retaining groove so that when opening sleeve 116 is located in first position 106 the collet will exert an outward force on retaining groove 72 thereby helping to maintain sleeve 116 in its first position 106. Collet head 128 further includes an outer downward facing shoulder 140. Downward facing shoulder 140 is an angular shoulder that extends in an upward and outward direction from diameter 133 to diameter 130 on collet heads 128. Collet head 128 also includes an inner downward facing shoulder 142.

The apparatus also has an actuating means 146 which may be characterized by an actuating ball or actuating plug 148. The actuating plug includes a head portion 150, a mid portion 152 and a neck or tail portion 154. Mid portion 152 has a lower end 153 and an upper end 155. A sealing shoulder 156 is defined on mid portion 154 at lower end 153 and will sealingly engage receiving seat 122. Mid portion 154 further includes a recess 158 that is directly opposed from collet heads 128 when shoulder 156 of actuating plug 148 sealingly engages receiving seat 122 as shown in FIGS.

2 & 10. An upward facing shoulder 157 is defined at a lower end 159 of recess 158.

Head portion 150 includes a first outer diameter 160 which is received in sleeve bore 119 and has clearance therebetween. A second outer diameter 162 defined on head portion 150 is slidably received in sleeve bore 119. Diameter 162 has a groove 164 with an o-ring 166 received therein for sealingly engaging sleeve bore 119.

To actuate the drill string diverter sub of the present invention, plug 148 is dropped into the drill string so that it engages the opening sleeve 116 as shown in FIG. 2. As fluid is displaced down the string behind the plug, pressure increases and forces the plug downward so that angled downward facing shoulder 140 of collet head 128 engages upward facing shoulder 74 of retaining groove 72. Because the shoulder 140 is angled, the sleeve will continue downward and collet heads 128 are forced into recess 158 of actuating plug 148. Sleeve 116 slides down until the outer diameter 130 of collet heads 128 engage inner surface 66 of housing 45. Once collet heads 128 clear groove 74, the actuating plug forces the opening sleeve downward until the lower end 118 of the opening sleeve engages snap ring 112 thereby holding the opening sleeve in its second position 108 as shown in FIGS. 3 and 4. When opening sleeve 116 is in its second position, fluid displaced down the drill string will enter central opening 68 and will be blocked by the plug from continuing down the string into the drill bit. The fluid is communicated to the well annulus from the central opening through the diverter ports and is directed into the side of the well bore at a sufficient velocity to remove gelled fluid and filter cake are removed therefrom.

Thus, the method of the present invention comprises dropping an actuating plug into the drill string after the well bore has been drilled and prior to removing the string from the well bore. The method further comprises displacing a fluid which may comprise drilling fluid, or any other fluid useful in removing gelled fluid and filter cake, down the string thereby increasing the pressure so that the opening sleeve is moved from its first position to its second position. Fluid is then continually pumped through the string and injected into the annulus through the diverter ports. Because the cross-sectional area of the diverter ports is less than the cross-sectional area of the central opening, the velocity of the fluid exiting the ports is greater than the velocity of the fluid entering the ports, and is sufficient to effect the removal of gelled mud and filter cake. Fluid is continuously displaced through the drill string so that the removed gelled mud and filter cake is transported to the surface. Because the diverter ports are offset, the fluid exiting the diverter ports causes a turbulent circular motion around the tool which enhances removal of gelled fluid and filter cake. Further, because the diverter ports are at an angle, fluid exiting the ports does not impinge directly on the well bore thus preventing the initiation of channeling or erosion in the walls of the well bore.

As the drill string is removed, fluid can be circulated at any location in the well to remove gelled fluid and filter cake therefrom. If desired, a fishing tool 200 can be lowered into the drill string to retrieve the actuating plug 148 and to move opening sleeve 116 back into its first position. As depicted in FIG. 4, the fishing tool can be utilized to clamp to tail portion 152 to retrieve the actuating plug. When the fishing tool is pulled upward, inner shoulder 142 of collet heads 128 will engage upward facing shoulder 159 defined on mid portion 154 of the actuating plug, so that opening sleeve 116 moves upward with the actuating plug. When collet heads 128 reach retaining groove 70, the collet heads will expand outward into the groove thus releasing the engagement between shoulder 159 and shoulder 142. The plug can then be retrieved and the opening sleeve will be retained in its first position. Thus, opening sleeve 116 can be alternated between its first and second positions, thus providing a means to wash the well bore at selected locations, and to continue drilling after the well bore has been washed. In other words, once the opening sleeve has been moved to its second position and the well bore washed at a location in the well, the opening sleeve can be returned to its first position and the well bore can be drilled to a lower depth, or the string can be retrieved up the well bore. The opening sleeve can then be moved into its second position as hereinbefore described and the walls of the well bore washed at a second location. This process can be repeated as many times as desired and at as many locations as desired.

The tool described herein can be used on wells which have any type of drive, including a rotary table or a top drive unit, and is especially useful on wells having a top drive unit, since with top drive units, the fluid input is integral with the top drive unit so that when the drill pipe is being removed fluid can be easily circulated between every connection.

Figure 5:
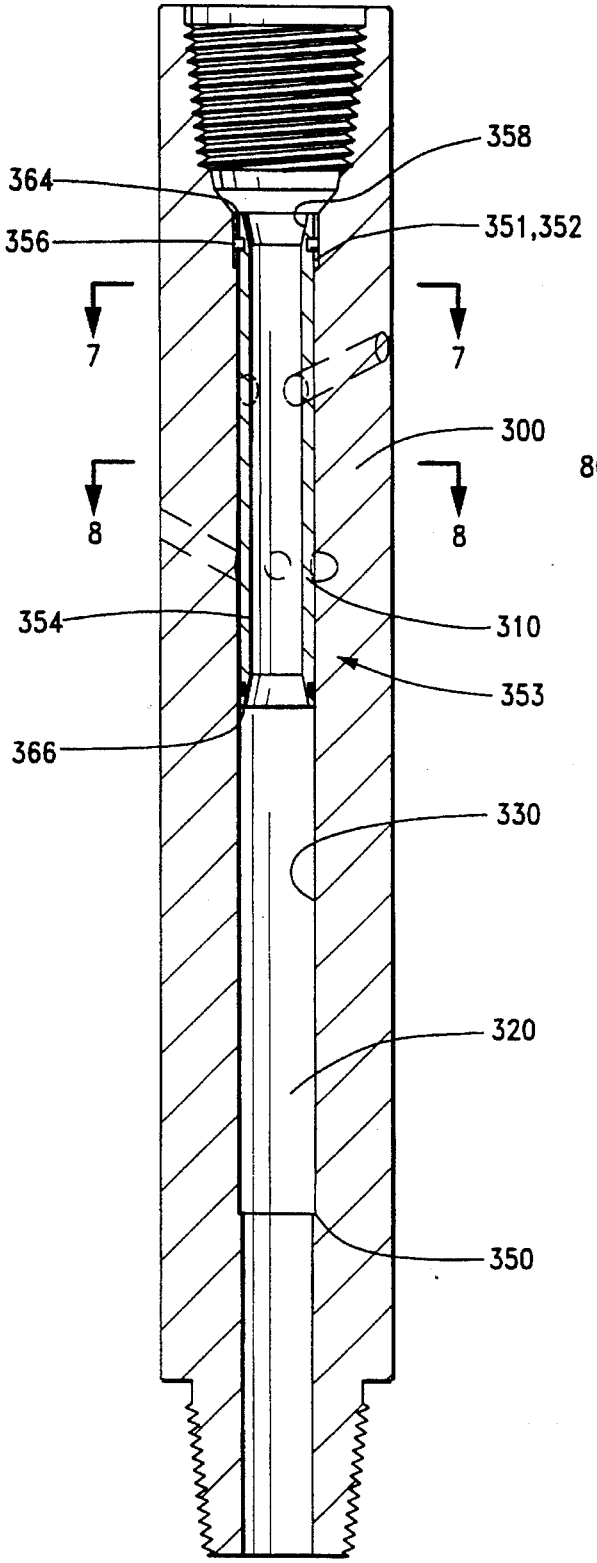
FIG. 5 shows a cross section of an additional embodiment of the present invention.
Figure 5:
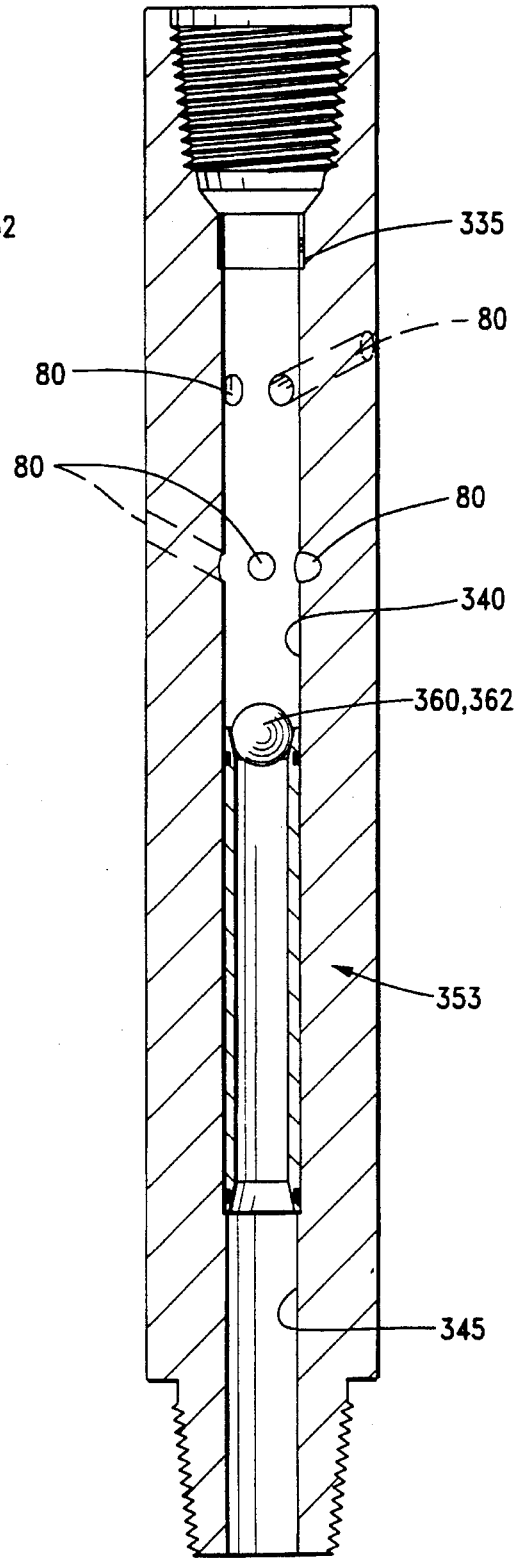

A second embodiment of the present invention is shown in FIGS. 5 and 6. As shown therein, the embodiment is identical in many aspects to the embodiment shown in FIGS. 1–4. The primary differences are in the valve means, the retaining means, and the limiting means. The embodiment shown in FIGS. 5–6 includes an outer housing 300 and a valve means 310. The housing is adapted to be connected to a drill string as hereinbefore described, and has a central bore 320 defined by an inner surface 330. Inner surface 330 includes a first diameter or groove 335, a second diameter 340 and a third diameter 345. An upward facing shoulder 350 is defined at the transition between second and third diameters 340 and 345 respectively. A retaining sleeve 352 is received in groove 335.

The diverter sub 300 has a retaining means 351 for holding valve means 310 in a first position 353. Retaining means 351 may comprise a retaining sleeve 352 received in first diameter 335. Valve means 310 may comprise a opening sleeve 354 slidingly and sealingly disposed in second diameter 340. Opening sleeve 354 is maintained in first position 353 with a plurality of shear pins 356 extending from retaining sleeve 352 into opening sleeve 354. Opening sleeve 354 further includes a receiving seat 358 for receiving and engaging an actuating means 360. Actuating means 360, which may comprise an actuation ball 362, is dropped into the drill string and engages receiving seat 358, which is defined on an upper end 364 of opening sleeve 354. As pressure is increased, shear pins 356 will break and the opening sleeve will drop until a lower end 366 thereof engages a limiting means. In the embodiment shown in FIGS. 5 and 6, the limiting means is characterized by shoulder 350. Thereafter, as fluid is displaced down the drill string, it will be diverted and directed into the diverter ports and into the well annulus as described hereinabove with respect to the previous embodiment and washing of the well bore occurs. The embodiment shown in FIGS. 5 and 6 cannot alternate between the first and second positions, but washing can occur at several locations as the drill string is retrieved.

By utilizing the drill stem diverter sub of the present invention, gelled fluid and filter cake can be removed from the sides of the well bore effectively and without the need for additional trips back into the hole with the drill string after it has been removed.

The present invention may also comprise a jetting sub 250 which will effectively remove gelled fluid, filter cake and other debris from equipment used on offshore drilling rigs such as, but not limited to, subsea assemblies and riser pipes without the need for special trips into the hole with a special jetting tool.

Figure 12:
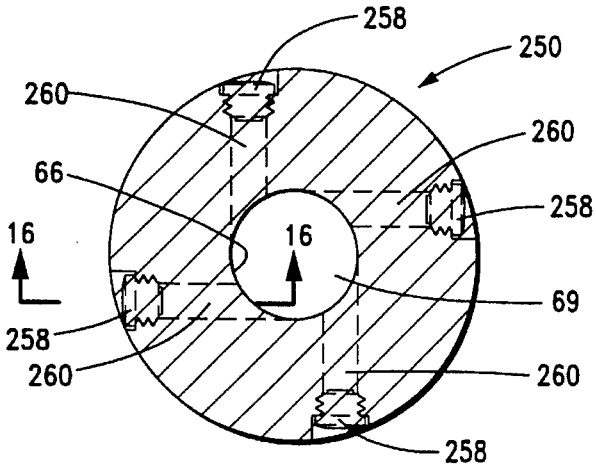
FIG. 12 shows a section view of the jetting tool of the present invention.
Figure 15:
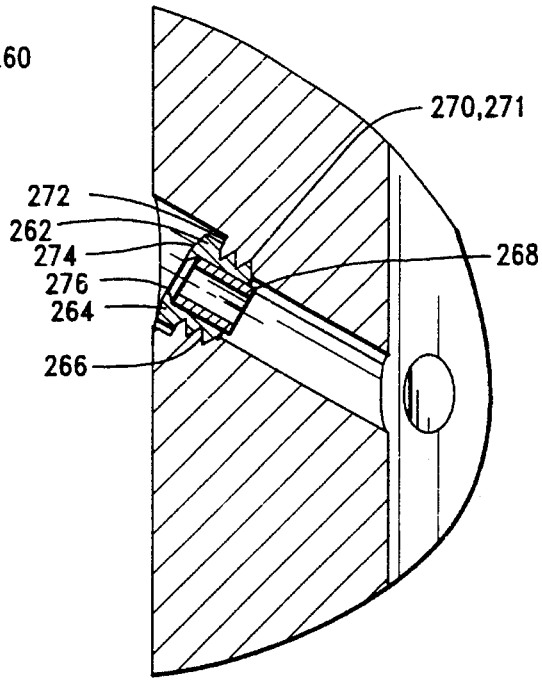
FIG. 15 schematically shows a jetting tool of the present invention in a riser pipe.
Figure 13:
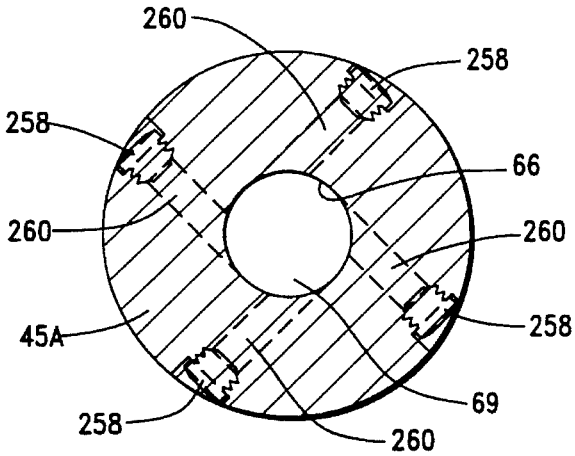
FIG. 13 shows a section view of the jetting tool.

Jetting sub 250 is shown in cross section in FIGS. 12 and 13, and is shown schematically in FIG. 15 as part of a jetting tool 252 for removing gelled mud, filter cake and other debris 253 from the walls of a subsea assembly 254 and riser pipe 256. Subsea assembly 254 is on the sea floor 255 and is positioned over the well bore 259. The riser pipe 256 extends downward from an offshore rig 257 and is connected to subsea assembly 254. Well bore 259 may have casing 261 received therein which extends downward from the sea floor. The tool 252 is comprised of jetting sub 250 disposed in a drill string which has a drill bit attached to a lower end thereof.

Referring now to FIGS. 12 and 13, which are views looking in the direction of FIGS. 7—7 and 8—8 of FIG. 3, the jetting sub shown therein is identical in all aspects to the diverter sub shown in FIGS. 1–4 and 7 & 8, except that jetting nozzles 258 are received in each diverter port 82 so that the diverter ports comprise jetting ports 260. Nozzles 258 may comprise a nozzle body 262 having a head 264 and a shank 266. Nozzle 258 also includes a nozzle insert 268 which is received in nozzle body 262, and which is fixed therein.

The housing of the jetting sub may include a counter bore, or recess 272, on its outer surface at each jetting port. The counter bore is of sufficient depth such that a top surface 274 of nozzle 258 does not extend beyond the outer surface of the housing. With the exception of the addition of the counter bore and the nozzle, the housing of the jetting sub and all other features of the jetting sub are identical to the diverter sub. The jetting sub housing may be referred to as housing 45A.

Jetting ports 260 have a thread 270 defined therein. The nozzles have an outer thread so that nozzles 258 are threadedly received in jetting ports 260 at threaded connection 271. Nozzle 258 has a exit diameter 276 which is smaller than the diameter of the diverter ports 82. Thus, fluid having the same linear velocity in the drill string will have a much higher exit velocity from the jetting sub than from the diverter sub.

The jetting tool 252 is especially useful for cleaning riser pipes and subsea assemblies on offshore rigs. The method of operation comprises attaching the jetting sub in the drill string with the drill bit therebelow as previously described with regard to the diverter sub. After drilling operations have commenced and the drill bit is being withdrawn from the offshore well for the purpose of removing the drill bit or otherwise, the sleeve 116 can be moved from its first to its second position as previously described herein with regard to the diverter tool. Fluid can then be displaced through the drill string so that it exits the jetting ports 260 at a sufficiently high velocity to clean gelled mud, filter cake and other debris from the subsea assembly and riser pipe as it is withdrawn to the platform of the offshore rig 257.

Thus, the method includes injecting fluid from the central flow passage of the drill string into an annulus 278 between the drill string and the subsea assembly and riser pipe, and into the walls or sides of the subsea assembly or riser pipe to remove gelled mud, filter cake and other debris therefrom. Gelled mud, filter cake and other debris will be removed from the subsea assembly 254 and riser pipe 256 as the drill string including the jetting sub 250 is removed and fluid is circulated down the drill string and jetted through the jetting ports at a high velocity. Once the drill string has been removed, the sleeve 116 can be placed back into the its first position so that the drill string can be lowered back into the well and drilling operations can continue. Each time the drill string is removed to inspect or replace the drill bit, the jetting sub can be actuated by moving the sleeve from its first to its second position, and the subsea assembly and riser pipe can be cleaned without the need for special trips for the purpose of removing gelled mud, filter cake and other debris.

It can be seen, therefore that the present invention is well adapted to carry out the ends and advantages mentioned as well as those inherent therein. While the preferred embodiments of the apparatus are shown for purposes of this disclosure, numerous changes in the arrangement and construction of part may be made by those skilled in the art. All such changes are encompassed within the scope and spirit of the amended claims.

What is claimed is:

1. An apparatus for removing gelled mud and filter cake from a side of a well bore comprising:

a housing adapted to be connected to a drill string, said drill string having a drill bit attached to a lower end thereof, said housing having a central opening defined therethrough, said central opening having a longitudinal central axis;

a plurality of diverter ports defined through said housing for providing communication between said central opening and a well annulus defined by said drill string and said well bore, each of said diverter ports having an entrance opening defined on said central opening and an exit opening defined on an outer surface of said housing and having a longitudinal central axis, wherein said longitudinal central axis of each of said diverter ports is offset from and does not intersect said longitudinal central axis of said central opening;

valve means disposed in said central opening, said valve means being releasably attached in a first position and being movable relative to said central opening from said first position wherein said diverter ports are closed by said valve means to a second position wherein said diverter ports are opened by said valve means, so that when said valve means is in said second position said well annulus and said central opening are in fluid communication; and actuation means for actuating said valve means from said first position to said second position.

2. The apparatus of claim 1, further comprising limiting means for limiting the movement of said valve means.

3. The apparatus of claim 2, wherein said limiting means comprises a shoulder extending radially inwardly into said central opening, wherein said shoulder holds said valve means in said second position.

4. The apparatus of claim 1, wherein said valve means comprises an opening sleeve having a collet defined on an upper end thereof, and wherein said collet engages a groove defined on said housing thereby releasably attaching said shoulder in said first position.

5. The apparatus of claim 1, wherein said valve means can be alternated between said first and second positions, so that said valve means can be moved from said second position to and releasably attached in said first position in said central opening.

6. The apparatus of claim 1, wherein said plurality of diverter ports comprises:

a first set of diverter ports, wherein said set of diverter ports is comprised of at least two diverter ports, said exit openings of said diverter ports in said set being located the same vertical distance from an upper end of said housing.

7. The apparatus of claim 6, wherein said plurality of diverter ports further comprises a second set of diverter ports, said second set of diverter ports being spaced vertically downward from said first set of diverter ports.

8. The apparatus of claim 7, further comprising jetting nozzles received in said exit openings of said diverter ports, wherein said diverter ports comprise jetting ports so that said apparatus comprises a jetting sub.

9. The apparatus of claim 1, wherein said exit openings are spaced vertically from said entrance openings.

10. The apparatus of claim 9, wherein said exit openings of said diverter ports are spaced vertically upward from said entrance openings so that said fluid communicated down said central opening and into said diverter ports is redirected in an upward direction as said fluid passes through said ports.

11. The apparatus of claim 10, further comprising jetting nozzles received in said exit openings of said diverter ports, wherein said diverter ports comprise jetting ports so that said apparatus comprises a jetting sub.

12. The apparatus of claim 1, wherein said longitudinal central axis of each of said diverter ports lies in a plane offset from and parallel to a plane defined by said longitudinal central axis of said central opening and a radial axis of said central opening.

13. The apparatus of claim 12, wherein said longitudinal central axis of said diverter port is parallel to said radial axis of said central bore.

14. The apparatus of claim 1, wherein each of said diverter ports has a long side and a short side, said long side defining a line tangent to said central opening.

15. The apparatus of claim 1, further comprising a jetting nozzle received in each diverter port wherein said plurality of diverter ports comprises a plurality of jetting ports, so that said apparatus comprises a jetting sub for removing gelled mud, filter cake and other debris from equipment used in the drilling of offshore wells.

16. The jetting sub of claim 15, wherein said valve means can be alternated between said first and second positions, so that said valve means can be moved from said second position to and releasably attached in said first position.

17. A diverter tool for removing gelled drilling fluid and filter cake from a side of a well bore, said diverter tool comprising:

a drill string diverter sub disposed in a drill string, said drill string having a drill bit at a lower end thereof, said drill string diverter sub comprising:

a housing having a central opening defined therethrough, said central opening being in communication with a central bore of said drill string so that fluid displaced downward through said drill string is communicated to said central opening;

a plurality of diverter ports defined through said housing communicating said central opening with a well annulus defined by said drill string and said side of said well bore, wherein each of said diverter ports has a longitudinal central axis and wherein said longitudinal central axis of each of said diverter ports lies in a plane parallel to and offset from a plane defined by a longitudinal central axis and a radial axis of said central opening; and an opening sleeve slidably disposed in said central opening, wherein said sleeve may be alternated between a first position wherein said opening sleeve prevents communication between said diverter ports and said central opening and a second position wherein said diverter ports and said central opening are in communication, flow through said drill string below said diverter ports being blocked when said opening sleeve is in said second position, so that when said opening sleeve is in said second position fluid displaced through said drill string is communicated from said central opening through said diverter ports and is directed into said annulus and into the side of said well bore, thereby removing gelled fluid and filter cake therefrom.

18. The tool of claim 17, wherein each said diverter port includes an exit opening defined on an outer surface of said diverter sub and an entrance opening defined at said central opening of said sub, said exit opening being spaced vertically from said entrance opening.

19. The tool of claim 18, wherein said exit opening is spaced vertically upward from said entrance opening so that fluid displaced down said drill string is redirected upward into said well annulus by said diverter ports when said opening sleeve is in its second position.

20. The tool of claim 18, further comprising a jetting nozzle received in each of said diverter ports, said diverter tool thereby comprising a jetting tool for removing gelled mud, filter cake and other debris from subsea assemblies and riser pipe used during the drilling of offshore wells.

21. The tool of claim 17, wherein said diverter ports include an entrance opening defined on said central opening of said housing and an exit opening defined on an outer surface of said housing, said plurality of diverter ports comprising a first set of diverter ports, said set of diverter ports comprising at least two diverter ports having exit openings spaced vertically downward the same distance from an upper end of said housing.

22. The tool of claim 21, wherein said set of diverter ports comprises four diverter ports defined through said housing.

23. The tool of claim 22, further comprising a jetting nozzle received in each of said diverter ports, said diverter tool thereby comprising a jetting tool for removing gelled mud, filter cake and other debris from subsea assemblies and riser pipe used during the drilling of offshore wells.

24. The tool of claim 21, wherein said exit openings are equally spaced radially around the outer surface of said housing.

25. The tool of claim 21, wherein said plurality of diverter ports further comprises a second set of diverter ports, said exit openings of said second set of diverter ports being spaced vertically downward from said exit openings of said first set of diverter ports.

26. The tool of claim 25, wherein said exit opening of each diverter port is spaced vertically from said entrance opening of said diverter port.

27. The tool of claim 26, further comprising a jetting nozzle received in each of said diverter ports, said diverter tool thereby comprising a jetting tool for removing gelled mud, filter cake and other debris from subsea assemblies and riser pipe used during the drilling of offshore wells.

28. The tool of claim 25, wherein each of said diverter ports has a longitudinal central axis and wherein said longitudinal central axis of each of said diverter ports lies in a plane parallel to and offset from a plane defined by a longitudinal central axis and a radial axis of said central opening.

29. The tool of claim 17, further comprising a jetting nozzle received in each of said diverter ports, said diverter tool thereby comprising a jetting tool for removing gelled mud, filter cake and other debris from subsea assemblies and riser pipe used during the drilling of offshore wells.

30. A method of removing gelled mud and filter cake deposited on a side of a well bore using a drill string having a drill bit attached to a lower end thereof comprising the steps of:

(a) displacing a fluid down a central flow passage of said drill string prior to removing said drill string from said well bore;

(b) obstructing flow through said central flow passage above said drill bit;

(c) communicating said fluid displaced down said drill string through a plurality of diverter ports defined in a drill string diverter sub disposed in said drill string from said central passageway to a well annulus defined by said drill string and said side of said well bore;

(d) directing said fluid into said side of said well bore above the point where said flow through said drill string is obstructed thereby removing gelled mud and filter cake from the side of said well bore;

(e) reopening said central flow passage so that fluid can be displaced therethrough;

(f) changing the vertical position of said drill string in said well bore; and (g) repeating steps (a)-(d) thereby removing gelled mud and filter cake from another location in said well bore.

31. The method of claim 30, wherein said directing step comprises jetting said fluid in an upward direction in said well annulus.

32. The method of claim 30, wherein said directing step comprises jetting said fluid into said well annulus so that said fluid circulates around said drill string thereby removing gelled mud and filter cake from said well bore.

33. The method of claim 30, further comprising, between steps (e) and (f) the step of blocking communication through said diverter ports.

34. The method of claim 30, wherein said step of changing the vertical position of said drill string comprises drilling said well bore to a greater depth.

35. A method of removing gelled mud and filter cake from walls of a well bore comprising:

(a) displacing a fluid down a drill string located in said well bore, said drill string having a drill bit attached to a lower end thereof;

(b) injecting a plurality of streams of said fluid through diverter ports into the walls of said well bore at a velocity sufficient to remove said gelled mud and filter cake therefrom, said diverter ports being offset from the longitudinal axis of said drill string so that said streams cause rotational flow around said drill string; and (c) moving said drill string vertically in the well so that said streams of fluid remove said gelled mud and filter cake from a desired location in said well bore.

36. The method of claim 35, wherein said diverter ports comprise an exit opening and an entrance opening, wherein said exit opening is displaced vertically from said entrance opening, said diverter ports thereby being at an angle such that said streams do not impinge directly on said walls of said well bore.

37. The method of claim 35, wherein said injecting step comprises:

(b)(1) opening said diverter ports, thereby establishing communication between said well bore and a central flow passage of said drill string;

(b)(2) obstructing flow through said drill string below said diverter ports.

38. The method of claim 37, further comprising:

(d) removing said obstruction from said drill string so that fluid can flow therethrough to said drill bit;

(e) closing said diverter ports thereby preventing communication between said drill string and said annulus through said diverter ports;

(f) moving said drill string vertically in said well to a second location; and (g) repeating steps (a)-(c).

39. A method of cleaning gelled mud filter cake and other debris from equipment used in the drilling of offshore wells comprising:

(a) after at least a portion of said offshore well bore has been drilled, withdrawing a drill string utilized to drill said well bore from the well bore through the equipment connecting said well bore to an offshore oil rig, said drill string having a drill bit attached to a lower end thereof; and (b) jetting a plurality of fluid streams through said drill string and into the sides of said equipment at a velocity sufficient to remove gelled drilling fluid, filter cake and other debris therefrom as said drill string is being withdrawn.

40. The method of claim 39, wherein said equipment comprises a subsea assembly located on the sea floor and a riser pipe connecting said subsea assembly to said offshore drilling platform.

41. The method of claim 40, wherein said drill string includes a jetting sub attached therein, said jetting sub comprising a plurality of jetting ports, and wherein said jetting step comprises:

(b)(1) displacing a fluid down said drill string;

(b)(2) opening said jetting ports;

(b)(3) obstructing flow through said drill string at a point below said jetting ports; and (b)(4) continuing to displace fluid down said drill string so that said fluid is injected through said jetting ports and into said equipment as said drill string is withdrawn.

42. The method of claim 41, further comprising:

(c) after said drill string has been withdrawn, removing said obstruction from said drill string so that flow can be established therethrough to said drill bit;

(d) closing said jetting ports so that communication therethrough is blocked;

(e) recommencing drilling operations; and (f) repeating steps (a)-(b).

43. The method of claim 41, wherein said jetting ports are offset so that said fluid streams create circular flow in the annulus around said drill string.

44. An apparatus for removing gelled mud and filter cake from a side of a well bore comprising:

a housing adapted to be connected to a drill string with a drill bit attached to a lower end thereof, said housing having a central opening defined therethrough;

a diverter port defined through said housing for providing communication between said central opening and a well annulus defined by said drill string and said well bore, wherein said diverter port includes a jetting means for increasing the velocity of fluid exiting the apparatus;

valve means disposed in said central opening, said valve means being movable from a first position wherein said diverter port is closed by said valve means to a second position wherein said diverter port is opened by said valve means, so that when said valve means is in said second position said well annulus and said central opening are in fluid communication; and actuation means for actuating said valve means from said first position to said second position.

45. The apparatus of claim 44, wherein said jetting means includes a jetting nozzle.

46. An apparatus for removing gelled mud and filter cake from a side of a well bore comprising:

a housing adapted to be connected to a drill string with a drill bit attached to a lower end thereof, said housing having a central opening defined therethrough;

a plurality of diverter ports defined through said housing for providing communication between said central opening and a well annulus defined by said drill string and said well bore;

wherein said diverter ports include an entrance opening defined on said central opening of said housing and an exit opening defined on an outer surface of said housing, said plurality of diverter ports comprising a first set of diverter ports, said set of diverter ports comprising at least two diverter ports having exit openings spaced vertically downward the same distance from an upper end of said housing;

wherein said plurality of diverter ports further comprises a second set of diverter ports, said exit openings of said second set of diverter ports being spaced vertically downward from said exit openings of said first set of diverter ports;

valve means disposed in said central opening, said valve means being movable from a first position wherein said diverter ports are closed by said valve means to a second position wherein said diverter ports are opened by said valve means, so that when said valve means is in said second position said well annulus and said central opening are in fluid communication; and actuation means for actuating said valve means from said first position to said second position.

47. The tool of claim 46, wherein said exit opening of each diverter port is spaced vertically from said entrance opening of said diverter port.

48. The tool of claim 46, wherein each of said diverter ports has a longitudinal central axis and wherein said longitudinal central axis of each of said diverter ports lies in a plane parallel to and offset from a plane defined by a longitudinal central axis and a radial axis of said central opening.

49. The tool of claim 46, further comprising a jetting nozzle received in each of said diverter ports, said diverter tool thereby comprising a jetting tool for removing gelled mud, filter cake and other debris from subsea assemblies and riser pipe used during the drilling of offshore wells.

50. A method of removing gelled mud and filter cake from a side of a well bore comprising:

(a) displacing a fluid down a drill string located in said well bore, said drill string having a drill bit attached to a lower end thereof;

(b) injecting a stream of said fluid through a diverter port and into the side of said well bore at a velocity sufficient to remove said gelled mud and filter cake therefrom, wherein said diverter port includes a jetting means for increasing the velocity of the exiting fluid; and (c) moving said drill string vertically in the well so that said fluid removes said gelled mud and filter cake from a desired location in said well bore.

* * * * *